United States Patent [19]

Morris et al.

[11] Patent Number: 4,791,991

[45] Date of Patent: Dec. 20, 1988

[54] SUBSURFACE WELL SAFETY VALVE WITH HYDRAULIC STRAINER

[75] Inventors: Arthur J. Morris, Magnolia; Jeffrey L. Knieriemen, Stafford, both of Tex.

[73] Assignee: Camco, Incorporated, Houston, Tex.

[21] Appl. No.: 164,697

[22] Filed: Mar. 7, 1988

[51] Int. Cl.[4] ..... E21B 34/10

[52] U.S. Cl. ..... 166/319; 166/332; 166/375

[58] Field of Search ..... 166/319, 332, 375, 316, 166/320, 334, 205, 374; 251/62, 63.5, 63.6

[56] References Cited

U.S. PATENT DOCUMENTS

| | | | |
|---|---|---|---|
| 4,161,219 | 7/1979 | Pringle | 166/324 |
| 4,276,931 | 7/1981 | Murray | 166/319 X |
| 4,350,205 | 9/1982 | Goldschild et al. | 166/375 |
| 4,574,894 | 3/1986 | Jadwin | 166/319 X |
| 4,691,777 | 9/1987 | Williamson, Jr. | 166/332 X |

*Primary Examiner*—Stephen J. Novosad
*Attorney, Agent, or Firm*—Fulbright & Jaworski

[57] ABSTRACT

The combination of a subsurface well safety valve which is controlled through a hydraulic fluid line extending from the well surface to the safety valve of a hydraulic strainer including a chamber positioned above the actuating hydraulic piston and cylinder assembly of the safety valve. A fluid passageway adapted to be connected to receive hydraulic control fluid from the well surface extends into the chamber and an outlet fluid passageway adapted to be connected to the hydraulic piston and cylinder assembly of the safety valve extends into the chamber. The lower end of the inlet fluid passageway is positioned between the upper end of the outlet fluid passageway for protecting the piston and cylinder assembly from debris. A filter may be provided in the chamber between the lower end of the inlet fluid passageway and the upper end of the outlet fluid passageway.

5 Claims, 5 Drawing Sheets

SUBSURFACE WELL SAFETY VALVE WITH HYDRAULIC STRAINER

BACKGROUND OF THE INVENTION

It is conventional to use a subsurface well safety valve as disclosed in U.S. Pat. No. 4,161,219 which is controlled by a hydraulic control line extending through the well surface. Such a safety valve may be positioned hundreds or even thousands of feet below the well surface and is designed to be operable for many years. However, debris may become trapped in the hydraulic control line such as when making up the connections, scale flaking off of the inside of the control line, or sediment in the control fluid settling out of the control line. In such instances, the debris would settle out on the hydraulic piston and cylinder assembly in the safety valve and possibly interfere with its operation.

The present invention is directed to the combination of a hydraulic filter with a safety valve for filtering the hydraulic fluid at a position adjacent the safety valve for reducing the possibility of debris accumulating upon the hydraulic piston and cylinder assembly. The hydraulic filter may be provide as a part of the safety valve, or in a separate tubing sub above the safety valve or as an attachment which may be connected to the outside of the production string.

SUMMARY

The present invention is directed to the combination with a subsurface safety valve for controlling fluid flow through a well conduit and including a housing having a bore and a valve closure member moving between open and closed positions for controlling fluid flow through the bore. A flow tube telescopically moves in the housing for controlling the movement of the valve closure member and biasing means move the tubular member in a direction to close the valve and a hydraulic piston and cylinder assembly actuates the valve closure member. The combination includes a hydraulic strainer which includes a closed chamber positioned above the hydraulic piston and cylinder assembly, an inlet fluid passageway having first and second ends in which the first end is adapted to receive hydraulic control fluid through a control line from the well surface and the second end extends into the chamber. An outlet fluid passageway is provided having first and second ends in which the first end extends into the chamber and the second end is connected to the hydraulic piston and cylinder assembly. The second end of the inlet fluid passageway is positioned away from the first end of the outlet fluid passageway for allowing debris to accumulate in the chamber and protect the piston and cylinder assembly.

Still a further object of the present invention is the provision of filter means in the chamber between the second end of the inlet fluid passageway and the first end of the outlet fluid passageway.

Still a further object of the present invention is wherein the chamber is positioned in the housing of the safety valve.

A still further object of the present invention includes a tubular sub having a body with a bore therethrough in which the body includes first and second ends and one of the ends is adapted to be connected to the top of the safety valve for placing the bore of the body in communication with the bore of the housing of the safety valve and the chamber is positioned in the body of the sub and outside the bore of the sub.

Still a further object of the present invention includes a body having connections for attachment to the exterior of a well pipe in which the chamber is positioned in the body.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENTS

Figure 1A:
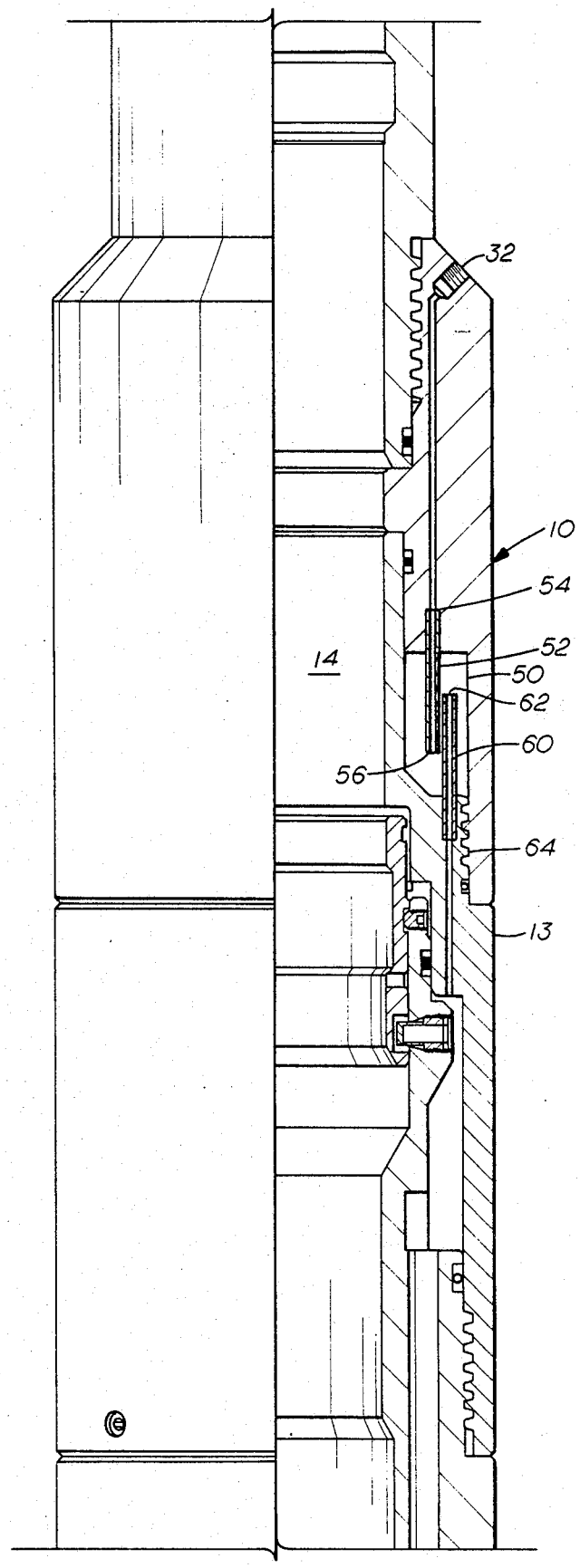
FIGS. 1A, 1B, 1C and 1D are continuations of each other and illustrate a subsurface well safety valve, in quarter section, including a hydraulic filter of the present invention.

While the present improvement will be described, for purposes of illustration only, as incorporated in a flapper type tubing retrievable safety valve, it will be understood that the present invention may be used with other types of safety valves.

Referring now to the drawings, and particularly to FIGS. 1A–1D, the subsurface safety valve of the present invention is generally indicated by the reference numeral 10 and is shown as being of a non-retrievable type for connection in a well conduit or tubing 11 such as by a threaded connection 12 at the bottom and a threaded connection (not shown) at the top for connecting the safety valve 10 directly into the production tubing 11 of an oil and/or gas well. Safety valve 10 generally includes a body or housing 13 adapted to be connected in a well tubing to form a part thereof and to permit the flow of well production therethrough under normal operating conditions, but in which the safety valve 10 may close or be closed in response to abnormal conditions such as might occur when the well overproduces, blows wild, or in the event of failure of well equipment.

The safety valve 10 generally includes a bore 14, a valve closure element or flapper valve 18 (FIG. 1D) connected to the body 13 by a pivot pin 20. Thus, when the flapper valve is in an upper position and seated on a valve seat 16, the safety valve 10 is closed blocking flow upwardly through the bore 14 and the well tubing 11. A tubular member or flow tube 22 is telescopically movable in the body 13 and through the valve seat 16.

Figure 1B:
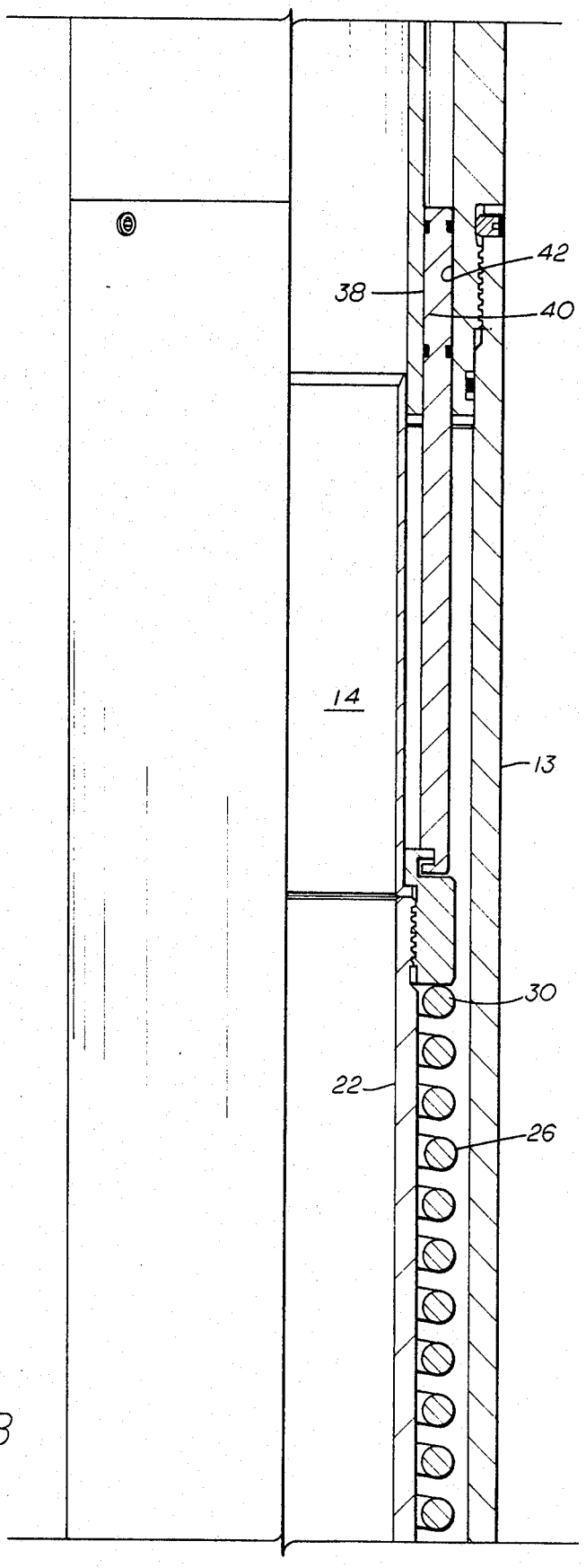
Figure 1C:
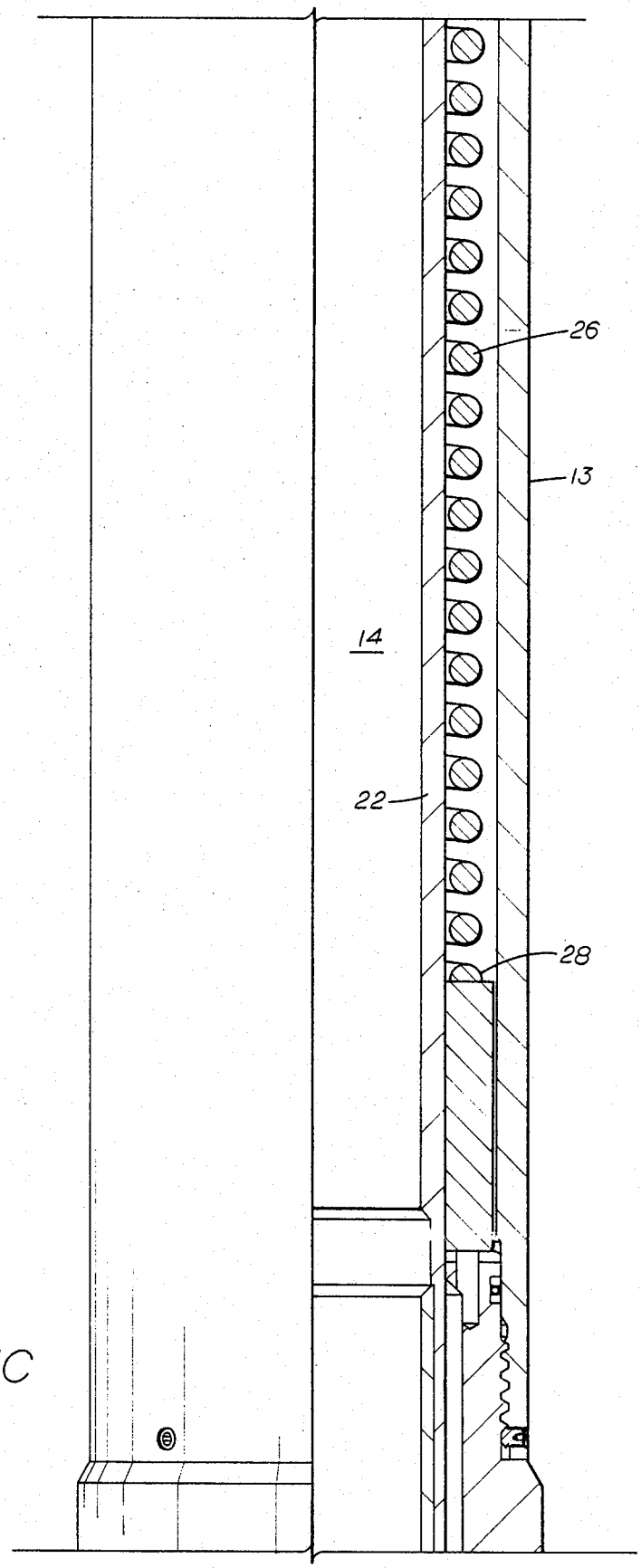
Figure 1D:
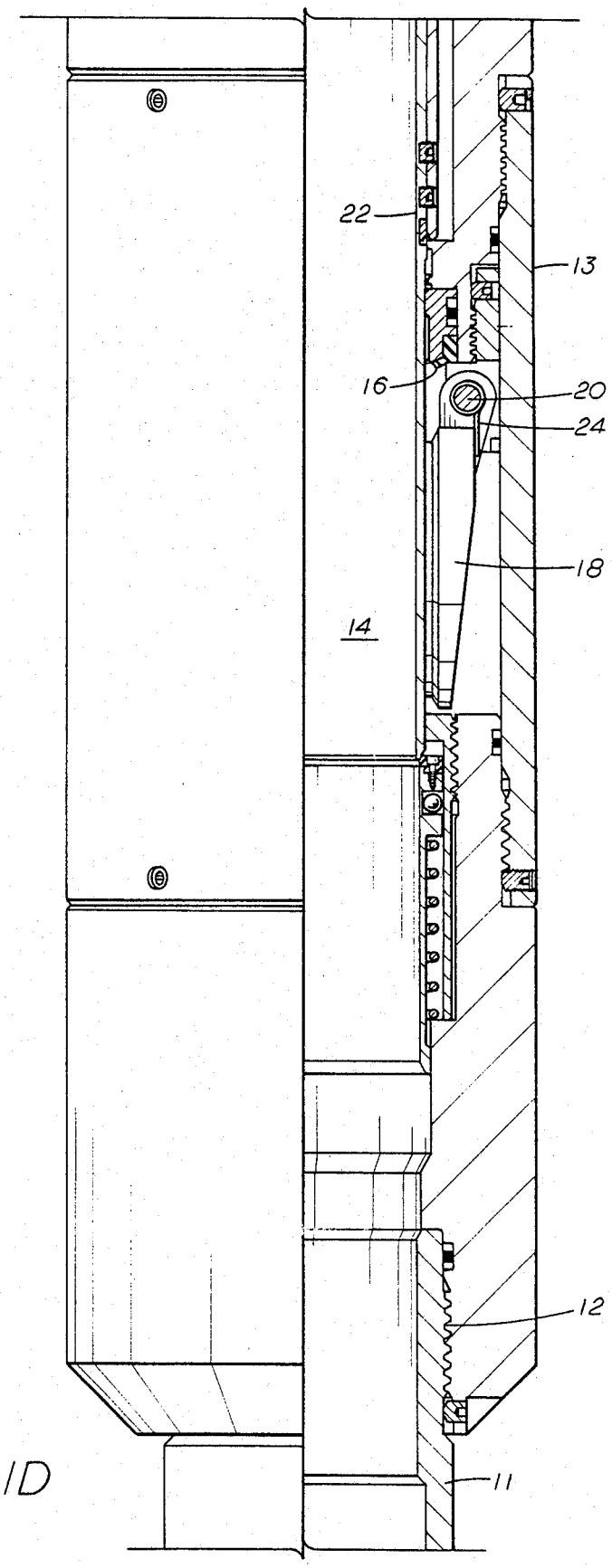

As best seen in FIG. 1D, when the flow tube 22 is moved to a downward position, the tube 22 pushes the flapper 18 away from the valve seat 16. Thus, the valve 10 is held in the open position so long as the flow tube 22 is in the downward position. When the flow tube 22 is moved upwardly, the flapper 18 is allowed to move upwardly onto the seat 16 by the action of a spring 24.

The safety valve 10 is controlled by the application or removal of hydraulic fluid through a control line (not shown) extending to the well surface and connected to a port 32 which supplies hydraulic fluid to the top of a piston and cylinder assembly 38 (FIG. 1B) which includes a piston 40 moving in a cylinder 42, one of which, such as piston 40, is connected to the flow tube 22 to move the flow tube 22 downwardly forcing the flapper 18 off of the seat and into the open position. If fluid pressure at the port 32 is reduced sufficiently relative to biasing forces urging the flow tube 22 upwardly, the tubular member 22 will be moved upwardly allowing the valve closure member 18 to close on the seat 16. Biasing means, such as a spring 26, which may act between a shoulder 28 on the valve body 13 and a shoulder 30 connected to the flow tube 22, yieldably urges the flow tube 22 in an upward direction to close the valve 10. In addition, fluid pressure of the production fluid in the bore 14 passes around the flow tube 22 and acts on the bottom of the piston 40 to bias the piston and cylinder assembly to a closed position.

The above description of the safety valve 10 is generally disclosed in U.S. Pat. No. 4,161,219, which disclosure is incorporated herein by reference.

However, the safety valve 10 is positioned hundreds of feet below the well surface, and possibly thousands of feet, and must remain in operative condition for years in order to protect the safety of the well. However, the piston and cylinder assembly 38 may become contaminated during makeup, or by debris in the hydraulic fluid settling out, or by other causes. Any debris will settle out on top of the piston and cylinder assembly 38. Such contamination can adversely affect the operation of the assembly 38.

Referring now to FIG. 1A, a chamber 50 is provided in the housing 13 at a position above the hydraulic piston and cylinder assembly 38 (FIG. 1B). An inlet fluid passageway 52 is provided having a first end 54 which is connected to the hydraulic fluid input port 32 and thus is adapted to receive hydraulic control fluid through a conventional control line (not shown) from the well surface. The second end 56 of the inlet fluid passageway 52 extends into the chamber 50.

An outlet fluid passageway 60 has a first end 62 extending into the chamber 50 and has a second end 64 connected to the hydraulic piston and cylinder assembly 38.

It is desirable that the second end 56 of the inlet passageway 54 is positioned away from the first end 62 of the outlet fluid passageway 60 for allowing any debris to settle out in the chamber 50. For example, the inlet passageway 54 and the outlet passageway 60 may be positioned 180° apart to discourage direct fluid communication.

Additionally the second end 56 of the inlet fluid passageway 54 may be positioned below the first end 62 of the outlet fluid passageway 60 for allowing debris to accumulate in the chamber 50. That is, any contaminating or debris in the fluid system above the chamber 50 will settle out into the bottom of the chamber from the second end 56 of the inlet passageway 52. However, hydraulic control fluid may still flow through the inlet fluid passageway 52 and into the chamber 50 and then into the outlet passageway 60 for controlling the hydraulic piston and cylinder assembly 38. It is preferable to extend the first end 62 of the outlet passageway 60 upwardly near the top of the chamber 50 for avoiding any contamination that may be stirred up by the incoming hydraulic fluid flowing out of the inlet passageway 52. Preferably the end 56 of passageway 52 is space above the bottom of the closed chamber 50 to avoid unduly stirring up any debris on the bottom. Thus, the chamber 50 acts as a filter trap to reduce contamination and debris particles from flowing down on top of the piston and cylinder assembly 38.

Figure 2:
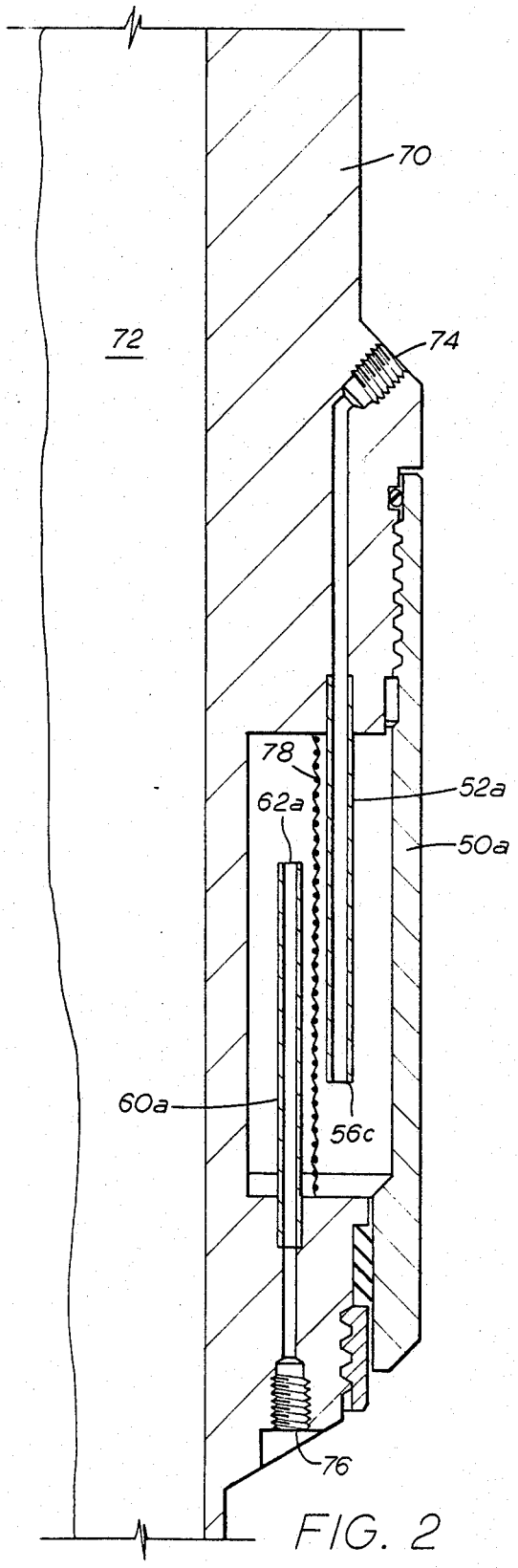
FIG. 2 is an enlarged fragmentary, elevational view, in cross section, illustrating another embodiment of the present invention in which a tubular well sub is provided with a hydraulic filter of the present invention.

Other and further embodiments may be provided, as hereinafter described, where like parts to those shown in FIG. 1A will be similarly numbered with the addition of the suffix "a" and "b". Referring now to FIG. 2, a fragmentary portion of a tubular sub 70 is shown having a bore 72 and threaded connections at each end (not shown) for connection into the production string 11. The sub 70 would be connected into the top of the safety valve with the bore 72 of the sub 70 being aligned with the bore 14 of the safety valve. In this embodiment the chamber **50*a* is positioned in the body of the sub 70 but outside of the bore 72. The inlet passageway 52*a* is connected to a port 74 for connection to the hydraulic fluid control line extending to the well surface. The outlet passageway 60*a* is connected to a port 76 for connection to the safety valve and the hydraulic piston and cylinder assembly therein. In the embodiment of FIG. 2, a filter 78 such as a screen is positioned in the chamber 50*a* between the end 56*a* of the inlet passageway 52*a* and the end 62*a* of the outlet passageway 60*a* for providing an additional barrier between the incoming control fluid and the outflowing control fluid. If desired, such a filter could be provided in the embodiment shown in FIG. 1A**.

Figure 3:
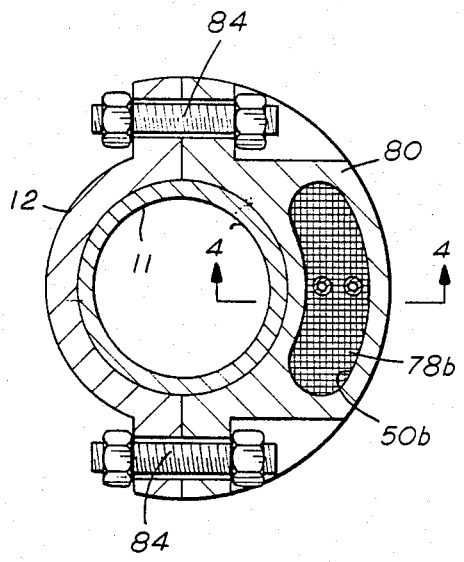
FIG. 3 is a cross-sectional view of another embodiment of the present invention, FIG. 4 a cross-sectional view taken along the line 4—4 of FIG. 3.
Figure 4:
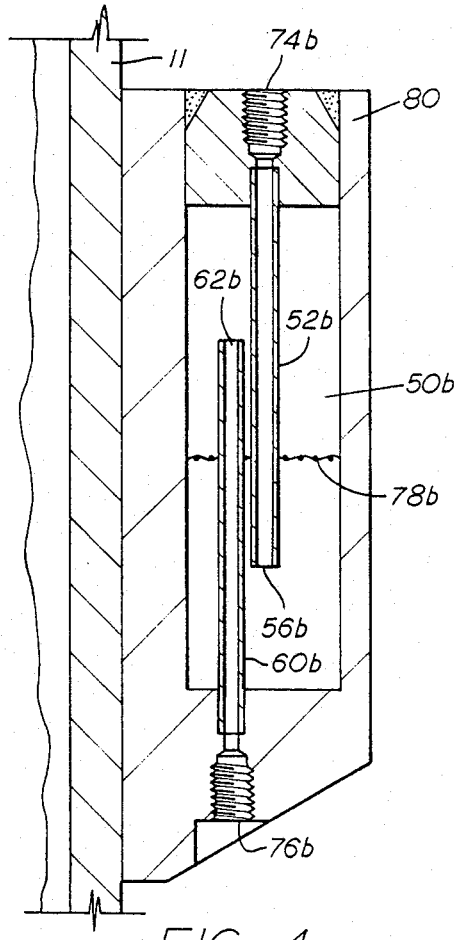

Referring now to FIGS. 3 and 4, another embodiment is shown in which a chamber **50*b* is provided in a body 80. Again, an inlet fluid passageway 52*b* is provided having a second end 56*b* extending into the chamber 50*b* with a second end connected to a port 74*b* for connection to a hydraulic fluid line extending to the well surface. An outlet passageway 60*b* is provided having a first end 62*b* extending into the chamber 50*b* and a second end connected to a port 76*b* for connection to a well safety valve and a hydraulic piston and cylinder assembly. A filter 78*b* may be provided in the chamber 50*b* between the flow path between end 56*b* and end 62*b*. As best seen in FIG. 3, the body 80 is adapted to be attached to the exterior of a portion of the well production tubing 11 at a position above the safety valve and connected to the exterior thereof by any suitable fastening means such as a suitable clamp member 82 and bolts 84**.

The embodiment of FIG. 2, while more expensive than the embodiments of FIGS. 3 and 4, provides a much more stable and rigid structure and connection. The embodiment of FIGS. 3 and 4 provides an inexpensive and easily installed structure which may be utilized with existing equipment to quickly and easily provide the desired combination of the present invention.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. In combination with a subsurface safety valve for controlling fluid flow through a well conduit and including a housing having a bore and a valve closure member moving between open and closed positions for controlling fluid flow through the bore, a flow tube telescopically moving in the housing for controlling the movement of the valve closure member, biasing means for moving the tubular member in a direction to close the valve and a hydraulic piston and cylinder assembly for actuating the valve closure member, of a hydraulic strainer comprising, means defining a closed chamber positioned above the hydraulic piston and cylinder assembly, means defining an inlet fluid passageway having first and second ends, said first end adapted to receive hydraulic control fluid through a control line from the well surface, said second end extending into the chamber, means defining an outlet fluid passageway having first and second ends, said first end of said outlet fluid passageway extending into the chamber, and the second end of said outlet fluid passageway connected in fluid communication to the top of the hydraulic piston and cylinder assembly, the second end of the inlet fluid passageway being positioned away from the first end of the outlet fluid passageway for allowing debris to accumulate in the chamber and protect the piston and cylinder assembly.

2. The apparatus of claim I including filter means in the chamber between the second end of the inlet fluid passageway and the first end of the outlet fluid passageway.

3. The apparatus of claim I wherein the chamber is positioned in the housing of the safety valve.

4. The apparatus of claim 1 including, a tubular sub having a body with a bore therethrough, said body including first and second ends, one of the ends adapted to be connected to the top of the safety valve and placing the bore of the body in communication with the bore of the housing of the safety valve, said chamber being positioned in the body of the sub and outside of the bore of the sub.

5. The apparatus of claim 1 including, a body having means for attachment to the exterior of a well pipe, said well pipe being connected to the top of and in fluid communication with the subsurface safety valve, and said chamber being positioned in said body.

* * * * *